US010184764B1

(12) United States Patent
Mark et al.

(10) Patent No.: US 10,184,764 B1
(45) Date of Patent: Jan. 22, 2019

(54) INSENSITIVE MUNITIONS LINER

(71) Applicant: The United States of America as Represented by the Secretary of the Army, Washington, DC (US)

(72) Inventors: Patrick Mark, Whitestone, NY (US); Daniel Lee Prillaman, Montclair, NJ (US); Leon Moy, Verona, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 15/431,022

(22) Filed: Feb. 13, 2017

(51) Int. Cl.
*F42B 12/20* (2006.01)
*B05D 1/06* (2006.01)
*F42B 12/80* (2006.01)

(52) U.S. Cl.
CPC ..... *F42B 12/207* (2013.01); *B05D 1/06* (2013.01); *F42B 12/80* (2013.01)

(58) Field of Classification Search
CPC ..... B05D 1/06; F24B 12/207; F24B 12/80
See application file for complete search history.

(56) References Cited

U.S. PATENT DOCUMENTS 5,054,399 A * 10/1991 Bilek ..... F42B 12/80 102/282
6,955,125 B1 * 10/2005 Mazzei ..... F42B 8/20 102/444
8,627,771 B1 * 1/2014 Gold ..... F42B 12/22 102/494
8,978,560 B1 * 3/2015 Stepanov ..... F42B 12/207 102/479
2009/0107572 A1 * 4/2009 Hayes ..... B32B 1/08 138/141
2010/0248862 A1 * 9/2010 Sullivan ..... A63B 37/0039 473/373
2012/0255456 A1 * 10/2012 Fink ..... F42B 39/14 102/481

* cited by examiner

*Primary Examiner* — Xiao S Zhao
(74) *Attorney, Agent, or Firm* — Michael C. Sachs

(57) ABSTRACT

A munition is rendered less sensitive to inadvertent initiations by providing a polymer liner on the entire inside surface of the munition. A thermoplastic liner may be fabricated totally within an empty inert munition casing by spraying a layer of electrostatically charged low melt thermoplastic material particles over substantially the entire inside surfaces of the munition casing, which casing is first electrically grounded. After thickening the particle layer through heat, further such layers may be then applied there over, until a desired cumulative thickness liner is fabricated.

1 Claim, 2 Drawing Sheets

INSENSITIVE MUNITIONS LINER

U.S. GOVERNMENT INTEREST

The inventions described herein may be made, used, or licensed by or for the U.S. Government for U.S. Government purposes.

BACKGROUND OF INVENTION

Explosives and propellants are often confined in munitions. When exposed to inadvertent events such as extreme heat, bullet impact, fragment impact, shape charge impact, or nearby munition explosions, the energetic materials may be initiated inadvertently. Such inadvertent initiations usually cause catastrophic explosions impacting persons, property, environment, and frequently cause damage to or loss of other nearby weapons, including due to fratricidal action.

Insensitive munitions may instead reduce the severity of reactions to external stimulus by various methods. One method is to minimize confinement of the energetics comprising propellants or explosives, e.g., so that the energetics will burn instead of detonate if totally confined. A way to do this in a conventional confined munition is to include vents in the munition for expansion of burning gases. Thereby the energetics will not be absolutely confined and cause an explosion. Most energetic materials outgas and expand during heating, causing an increase in pressure. However, the gases causing this pressure are sometimes unable to reach the desired vents to relieve this pressure, or the vents may have been plugged up, though such vents may indeed have been initially provided. Despite provision of these vents in such cases one could still have the unwanted explosions due to confinement.

An improved approach according to this invention is to always specifically include a melt able inert liner material between the metal casing and the energetic. The object is to take up space with the liner material where this space might be later used to lessen the confinement above mentioned, if the liner material's space could be freed away when it is needed for expansion. In this case, if the liner melts as planned, that would provide a pathway to relieve pressure imparted onto the energetic by confinement.

One problem involved in fabricating and providing such liners is that munitions often have small mouth openings that prevent a liner from being fabricated outside of the munition and then later inserted. This might seem to limit the usage of insensitive munitions liners for these applications.

Another approach might be to insert rigid pre-fabricated sleeves into an existing munition. A warhead might be redesigned to enlarge the openings into the munition solely to allow insertion of the pre-fabricated sleeve. Then, the smaller opening to the munition could be restored by then adding additional metal parts to recreate a small mouth opening for the munition. A problem with the above is that changing the size of the metal part opening often changes the weight, interfaces, and lethality profile of a munition. The approach is also costly. It is also difficult to retrofit already existing manufactured parts, and to do so with dependable consistency.

SUMMARY OF THE INVENTION

Methods are described which may enable fabrication of liners inside a munition without need for later insertion of a liner into a munition at all. The invention describes a method of adhering a polymer liner within a munition. As such, liners can then be fabricated within a munition, requiring no changes to any existing parts. Such liners have been proven to be able to melt out properly. Limited explosive loading tests of such munitions have proven successful. Plastic liner materials which might be used include any suitable low-melt temperature material such as HDPE (high density poly ethylene), or other thermoplastic materials. This approach would certainly be applicable to all non-melt pour explosive munitions which munitions require assistance for venting; munitions with long propellant beds might benefit most.

A method according to the invention uses thermoplastic powder coating to apply a low melt liner to the inside of a warhead. The powder is sprayed inside in layers to build up the liner material. This approach is better than previous methods since it allows a low melt liner to be applied directly to the inside of a warhead case, even through a small mouth opening, and without the later need of insertion of a liner. This method can also result in sealing of the venting holes by depositing material into the holes during the procedure.

Other approaches involve applying the thermoplastic powder by a method of blow molding, or by a method of rotational molding, or by a method of non-powder spraying.

A sequence of operation in this invention could include the following. First, a warhead casing to be worked on is electrically grounded, then a powder coating device is inserted into an open side of the warhead. Next, electrically charged thermoplastic powder is sprayed onto the inside of the warhead body. It will be appreciated that the electrically charged thermoplastic powder would better adhere to the inside of the warhead body, because of the static electricity. As a further step, the warhead could then be heated in temperature to thicken the coating of the first layer. Then, the coating of subsequently applied layers over it can rely on melting rather than on electrical charge attraction to adhere, and thus subsequently to build the layers.

OBJECTS OF THE INVENTION

Accordingly, it is an object of the present invention to provide means for coating the inside surfaces of an empty, inert munition casing with a layer of thermoplastic material.

Another object of the present invention is to provide means for drying a previously applied layer of thermoplastic material coating on the inside surfaces of an empty, inert munition casing.

It is a further object of the present invention to provide means for further coating over a previously dried coating or coatings of thermoplastic material on the inside surfaces of an empty, inert munition, to thereby fabricate a thermoplastic material liner permanently there from.

These and other objects, features and advantages of the invention will become more apparent in view of the within detailed descriptions of the invention, the claims, and in light of the following drawings wherein reference numerals may be reused where appropriate to indicate a correspondence between the referenced items. It should be understood that the sizes and shapes of the different components in the figures may not be in exact proportion and are shown here just for visual clarity and for purposes of explanation. It is also to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive. Numerous other modifications can be made when implementing the invention for a particular environment, without departing from the spirit and scope of the invention.

LIST OF DRAWINGS

DETAILED DESCRIPTION

Figure 1:
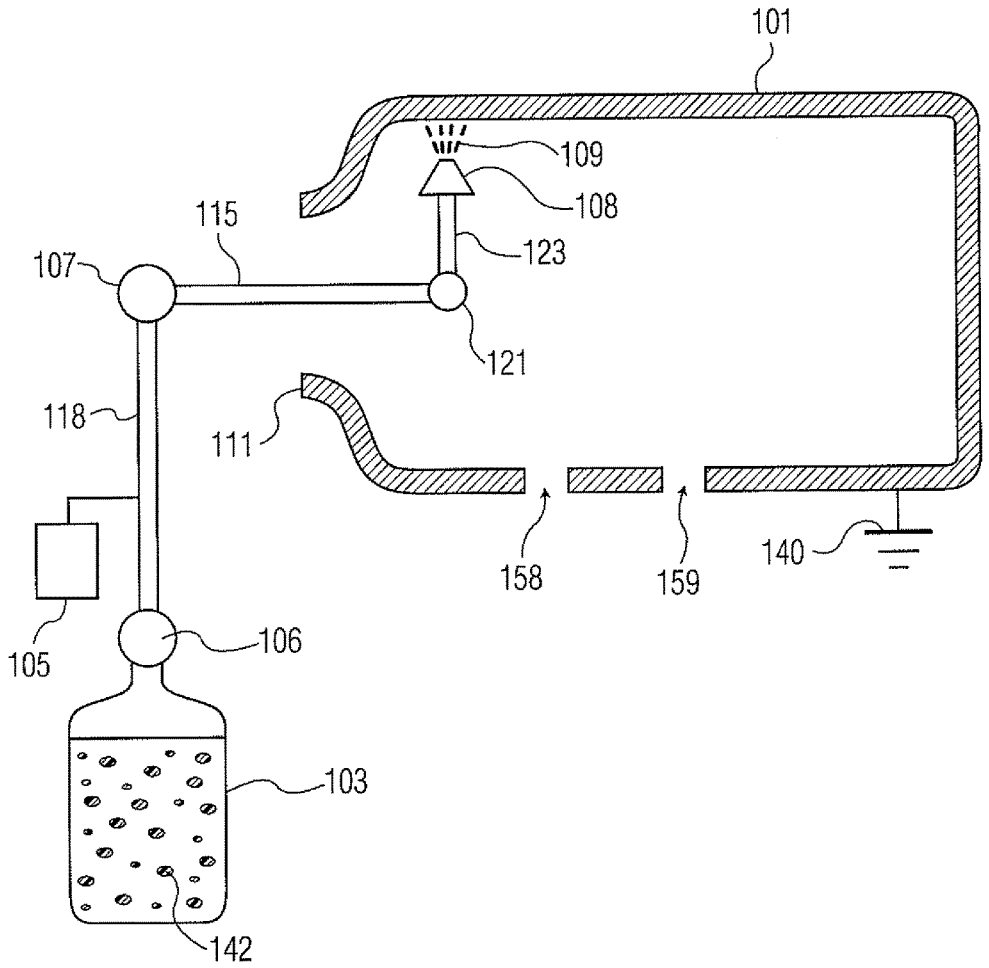
FIG. 1 illustrates a cross sectional view of a thermoplastic particle coating system for the interior surfaces of an empty munition casing according to this invention.

FIG. 1 shows application of thermoplastic powder to the inside of a sample warhead casing 101, which has a mouth opening 111. It is desired to ultimately apply a coating of at least 0.1 inch depth of thermoplastic powder granules across every part of the interior surface of sample warhead casing 101. The warhead casing material may be of a metal such as steel, or of another metal, or even of another type material. The casing 101 is electrically grounded, as shown at 140, in at least the first step of the operation, but preferably throughout the entire process. A supply of thermoplastic powder granules 142 is preloaded at container 103; the size of a mean thermoplastic powder granule is approximately between 210 and 297 microns, though other sizes might be used.

Figure 2:
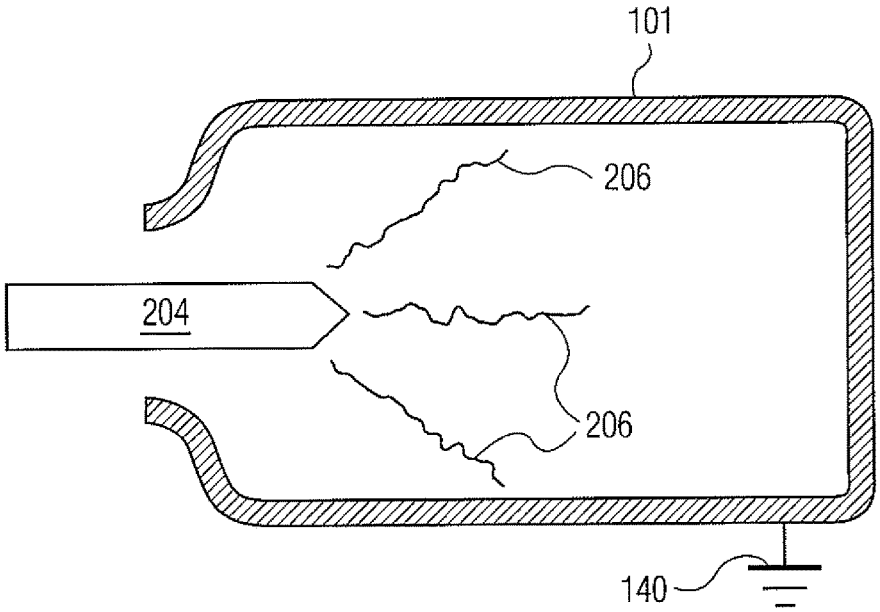
FIG. 2 shows a cross sectional view of a system for drying a coating of thermoplastic material previously applied on the interior surfaces of an empty munition casing according to this invention.

The thermoplastic powder may conceivably be applied as droplets in a liquid solution form, as opposed to dry granules. Thermoplastic powder granules may be pumped from container 103 by pumping means 106, along pipe tool 118. Along with pumping means 106 is also a means 105 to selectively apply an electrostatic charge to the pumped granules in at least the first step or early steps of the operation, but preferably throughout the entire process. Another approach is using a unitary powder coating gun that uses pressurized air and also electrical charge, to disperse the material. Pipe tool 118 pivots at first flexible joint 107 to allow granules to flow along first arm 115. First arm 115 in turn pivots at second mechanized flexible joint 121 to allow granules to flow along second arm 123. At the distal end of second arm 123 is a nozzle 108 which allows sprayed granules 109 to be applied to a location or locations along the inside of casing 101. Second arm 123 with nozzle 108 must be sized so that it can be entered into mouth 111 and be maneuvered about with second mechanized flexible joint 121 to spray along all the inside surface of casing 101. Ideally its overall length would be less than the about half the diameter of casing 101 while also less than the diameter of mouth 111. The arms 115, 123 and piping 118 may be made of a rigid material such as metal or plastic, but could also suitably be made of more flexible materials to more easily allow for maneuverability of arm 123 with nozzle, all within the casing 101. The sequence of operation in this invention would include the following. First, the warhead casing 101 to be worked on is electrically grounded, then powder coating means, second arm 123 with nozzle 108, is inserted into an opened mouth 111 of the warhead casing. Next, electrically charged thermoplastic powder (through 103, 105, 118, 115, 123, 108) is sprayed onto the inside of the warhead body. The electrically charged thermoplastic powder will adhere to the inside of the warhead body further aided by the effects of static electricity. In FIG. 2, as a next step, the warhead casing 101 may be then heated in temperature by blower 204, releasing heat waves 206, or through some other heating means, e.g., to thicken 201, the coating of the first layer. It may take about 5 minutes for the first coating to wet out or thicken. This amount may vary; it may be seen as a balance of how much is sprayed on and the temperature the warhead is heated to. The casing 101 may be grounded at 140 as a safety precaution. There are many other ways to heat layer 201 at this point, another example being by placing an empty inert casing 101 into a suitable oven device. After thickening of first layer 201, subsequent layers may be applied over it, such as described with reference to FIG. 1. If applied over a still warm first layer 201, the coating of subsequently applied layers over it can also rely on melting rather than on electrical charge attraction to adhere, and thus subsequently to build the layers of thermoplastic powder into an acceptable liner. Or, subsequent coatings could still be applied over an only ambient temperature first layer 201, by methods such as were described with reference to FIG. 1. If the munition casing is of a type that has vents (such as 158, 159 for instance) in one approach, to improve the surface profile of the coating the vents may be plugged with a set screw that can be removed later. This would allow a meltable screw to be put in after the coating and energetic loading is completed. There are some advantages to allowing the thermoplastic material to fill the vent holes, since it makes it a single component with a tight seal. The disadvantage is that under high pressure loading the explosive can extrude the plastic if there isn't a tightly fitting sleeve within the tooling covering the holes to take the load. One typical munition casing considered has twelve 0.44" vent holes.

While the invention may have been described with reference to certain embodiments, numerous changes, alterations and modifications to the described embodiments are possible without departing from the spirit and scope of the invention as defined in the appended claims, and equivalents thereof.

What is claimed is:

1. A method for rendering a munition less sensitive to inadvertent initiations by providing a polymer liner on the entire inside surface of the munition, wherein the process of providing the polymer liner comprises applying a layer inside the empty inert munition's casing by spraying a first coating of electrostatically charged low melt thermoplastic material particles over substantially the entire inside surfaces of the munition casing, wherein the casing is electrically grounded, then, said first coating is thickened through heat, and thereafter additional coatings are sequentially applied over the thickened first coating, until a desired cumulative layer thickness is accomplished, thereby fabricating said polymer liner, and where the munition casing has venting holes, and the applied layers cover over any venting holes which may have been provided in said munition wherein the venting holes are initially plugged with screws so the applied layers will cover over the screws and holes, and wherein the screws are replaced by meltable screws after the first coating and the additional coatings have been accomplished.

* * * * *